US006650296B2

(12) United States Patent
Wong et al.

(10) Patent No.: US 6,650,296 B2
(45) Date of Patent: Nov. 18, 2003

(54) DUAL-BAND MONOPOLE ANTENNA

(75) Inventors: Kin Lu Wong, Kaohsiung (TW); Shih Huang Yeh, Douliou (TW)

(73) Assignee: Accton Technology Corporation, Hsinchu (TW)

( * ) Notice: Subject to any disclaimer, the term of this patent is extended or adjusted under 35 U.S.C. 154(b) by 0 days.

(21) Appl. No.: 10/118,003

(22) Filed: Apr. 9, 2002

(65) Prior Publication Data

US 2003/0132882 A1 Jul. 17, 2003

(30) Foreign Application Priority Data

Jan. 16, 2002 (TW) ..... 91100832 A

(51) Int. Cl.[7] ..... H01Q 1/38
(52) U.S. Cl. ..... 343/700 MS; 343/702
(58) Field of Search ..... 343/700 MS, 828, 343/702, 846, 795; 455/90

(56) References Cited

U.S. PATENT DOCUMENTS 6,008,774 A 12/1999 Wu ..... 343/828
6,166,694 A 12/2000 Ying ..... 343/702
6,408,190 B1 * 6/2002 Ying ..... 455/553
6,414,640 B1 * 7/2002 Eggleston ..... 343/702

* cited by examiner

*Primary Examiner*—James Clinger

(57) ABSTRACT

A dual-band monopole antenna mainly comprises a microwave substrate, a first horizontal radiating metallic line, a second horizontal radiating metallic line, a vertical radiating metallic line, a feeding point, and a ground plane. The microwave substrate includes a first surface and a second surface. The first horizontal radiating metallic line is printed on the first surface. The second horizontal radiating metallic line is printed on the first surface. The vertical radiating metallic line is printed on the first surface, wherein the first horizontal radiating metallic line and the second horizontal radiating metallic line respectively intersect the vertical radiating metallic line at different positions. The feeding point is disposed on the vertical radiating metallic line, and a ground plane is printed on the second surface of the microwave substrate.

12 Claims, 4 Drawing Sheets

DUAL-BAND MONOPOLE ANTENNA

BACKGROUND OF THE INVENTION

1. Field of the Invention

This invention relates to an antenna for the wireless communication system, and more particularly to a dual-band monopole antenna for the wireless local area network (WLAN) system.

2. Description of the Related Art

With the development of the communication industry in recent years, markets of the WLAN (wireless local area network) have been gradually growing. In conventional techniques, there have been developed many antennas used in wireless communication devices, such as U.S. Pat. No. 6,166,694 issued to Ying on Dec. 26, 2000 entitled "Printed twin spiral dual band antenna," which discloses a communication device for the wireless communication system. The communication device includes a printed circuit board, a dielectric substrate adhered on the printed circuit board, and an antenna printed on the dielectric substrate. However, the antenna is printed on the dielectric substrate and then disposed on the printed circuit board by the surface mounted technology, so the process of the antenna is complicated and expensive and the antenna occupies quite a large area, therefore such antenna does not meet the demand for reduced volumes of current electronic products.

U.S. Pat. No. 6,008,774 issued to Wu on Dec. 28, 1999 entitled "Printed antenna structure for wireless data communication," which discloses a printed antenna used for laptop computers in WLAN or other types of small, portable, wireless data communication products including a printed circuit board, a hook-shaped radiating metallic line printed on the top surface of the printed circuit board, a feeding point connected to the hook-shaped radiating metallic line, and a ground plane printed on the bottom surface of the printed circuit board. Compared with the above mentioned patent, this invention is characterized in that the antenna is printed on a peripheral card and directly integrated with the system circuit on the peripheral card. However, the antenna is only used for WLAN operation in the 2.4 GHz band.

Accordingly, many antennas in the wireless communication network card equipped in various types of the current electronic products are only operated at a single frequency band. Therefore, it is expected that, with the growing of the market, the performance and the market competitiveness of the wireless communication network card equipped with the antenna that is operated only at a single frequency band are insufficient. Accordingly, to develop the antenna in the wireless communication network card capable of operating in dual bands is the mainstream trend of related electronic products.

In addition, current electronic products are designed to be light, thin, short and small, so it is expected that the volume of the wireless communication card equipped in all types of electronic products will have the light, thin and clever features and appearances. In this condition, the volume of the antenna equipped in the wireless communication network card will be confined in a specific volume.

Accordingly, there exists a need to provide an antenna capable of easily operating in dual bands and suitable for WLAN operation, and the antenna has the light, thin and small features so as to meet the reduced-volume requirement of current electronic products.

SUMMARY OF THE INVENTION

It is a primary object of the present invention to provide a dual-band monopole antenna which can be operated in dual bands and easily tuned to the frequency band required for WLAN operation by means of adjusting the resonant frequencies of the antenna.

It is another object of the present invention to provide a dual-band monopole antenna, wherein the antenna occupies a minimum area and is integrated with the system circuit of the microwave substrate.

In order to achieve the above objects, a dual-band monopole antenna of the present invention comprises a microwave substrate, a first horizontal radiating metallic line, a second horizontal radiating metallic line, a vertical radiating metallic line, a feeding point, and a ground plane. The microwave substrate includes a first surface and a second surface. The first horizontal radiating metallic line is printed on the first surface. The second horizontal radiating metallic line is printed on the first surface. The vertical radiating metallic line is printed on the first surface, wherein the first horizontal radiating metallic line and the second horizontal radiating metallic line respectively intersect the vertical radiating metallic line at different positions. The feeding point is disposed on the vertical radiating metallic line, and the ground plane is printed on the second surface of the microwave substrate.

According to another aspect of the present invention, the first horizontal radiating metallic line is connected to one end of the vertical radiating metallic line or the vicinity thereof opposite to the feeding point, the second horizontal radiating metallic line is connected to the vertical radiating metallic line at the position different from where the first horizontal radiating metallic line is connected to, and the other ends (free ends) of the two horizontal radiating metallic lines extend outwards in the same direction, whereby the antenna is formed as an F shape.

According to a further aspect of the present invention, the path from the feeding point through the vertical radiating metallic line to the free end of the first horizontal radiating metallic line forms a first resonant path of the antenna in operation and determines the first (the lower) operating frequency thereof, and the path from the vertical radiating metallic line to the free end of the second horizontal radiating metallic line forms a second resonant path of the antenna in operation and determines the second (the higher) operating frequency thereof.

According to a still further aspect of the present invention, the feeding point is connected to a feeding metallic line for signal transmission.

According to a still further aspect of the present invention, the feeding metallic line is printed on the first surface.

According to a still further aspect of the present invention, the feeding metallic line is a 50-Ω microstrip line.

According to a still further aspect of the present invention, the ground plane has a breach corresponding to a region of the first surface of the microwave substrate, the region includes the first horizontal radiating metallic line, the second horizontal radiating metallic line and the vertical horizontal radiating metallic line.

According to the present invention, tuning of the above-mentioned two resonant frequencies of the antenna is very easy by means of adjusting the lengths of the first and second horizontal radiating metallic lines, and further tuning the antenna to the frequency band required. In addition, the antenna of the present invention is a planar structure, and therefore it has high integration with the microwave electric circuit. The antenna according to one embodiment of the present invention can be operated in dual bands at 2.4 GHz and 5.2 GHz for WLAN operations, and has a desirable antenna gain in the operating frequency bands.

BRIEF DESCRIPTION OF THE DRAWINGS

Other objects, advantages, and novel features of the invention will become more apparent from the following detailed description when taken in conjunction with the accompanying drawings.

DETAILED DESCRIPTION OF THE PREFERRED EMBODIMENT

Figure 1:
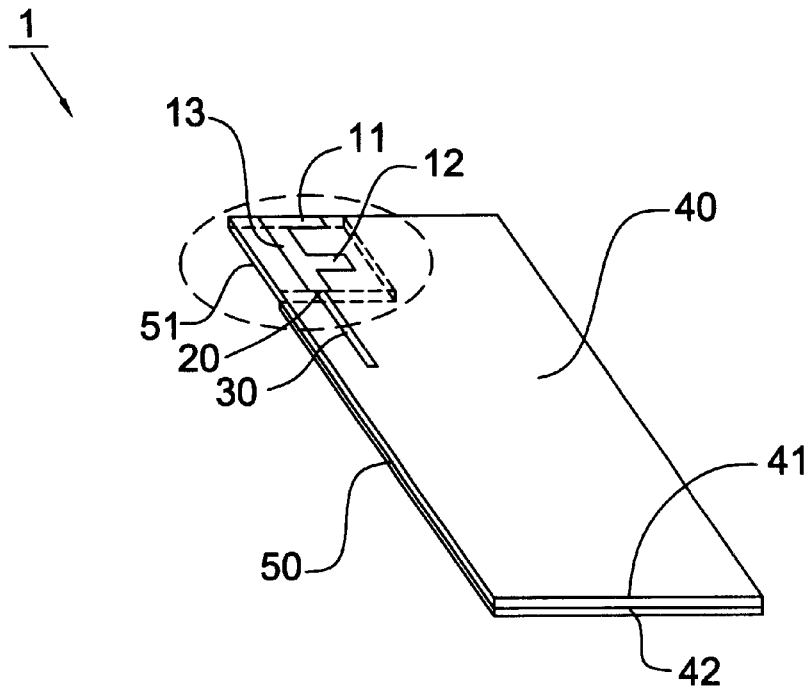
FIG. 1 is a perspective view of a dual-band monopole antenna printed in a corner of a microwave substrate in accordance with a preferred embodiment of the present invention.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiments illustrated.

As shown in FIG. 1, it depicts a dual-band monopole antenna 1 according to the present invention which is printed in a corner of a microwave substrate 40. The microwave substrate 40 is constructed by a circuit board of a wireless communication network card which is 45×80 $mm^2$ in size. The microwave substrate 40 is generally formed by a printed circuit board made of BT (bismaleimide-triazine) resin or FR4 fiberglass reinforced epoxy resin, or a flexible film substrate made of polyimide. Since the antenna 1 is printed in the corner of the microwave substrate 40, the antenna 1 occupies a minimum area thereof, and due to the planar characteristic of the designed structure of the antenna 1, it has high integration with the system circuit of the microwave substrate 40, whereby the light, thin and small-area characteristics can be obtained and the reduced-volume requirement of current electronic products can be met.

Figure 2:
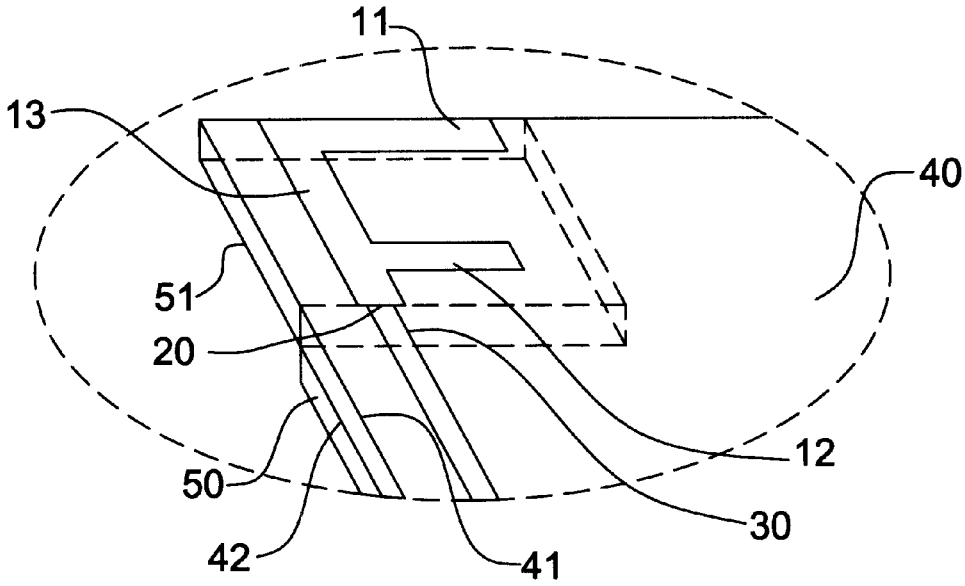
FIG. 2 is a perspective view of a dual-band monopole antenna in accordance with a preferred embodiment of the present invention.

Referring now to FIG. 2, it depicts the dual-band monopole antenna 1 in accordance with the present invention mainly comprising: a microwave substrate 40, a first horizontal radiating metallic line 11, a second horizontal radiating metallic line 12, a vertical radiating metallic line 13, a feeding point 20, and a ground plane 50. The microwave substrate 40 includes a first surface 41 having a feeding metallic line 30 which is a 50-Ω microstrip line for signal transmission and a second surface 42. The first horizontal radiating metallic line 11 is printed on the first surface 41. The second horizontal radiating metallic line 12 is printed on the first surface 41 and below the first horizontal radiating metallic line 11. The vertical radiating metallic line 13 is printed on the first surface 41 and substantially perpendicular to the first horizontal radiating metallic line 11 and the second horizontal radiating metallic line 12. The feeding point 20 is disposed on the vertical radiating metallic line 13 for connecting the feeding metallic line 30 to the vertical radiating metallic line 13 so as to transmit signals. The ground plane 50 is printed on the second surface 42 and served as a ground plane of a wireless communication card, and the ground plane 50 has a rectangular or substantially rectangular breach 51, over which the antenna 1 is directly disposed. In this embodiment, the first horizontal radiating metallic line 11 is connected to one end of the vertical radiating metallic line 13 or the vicinity thereof opposite to the feeding point 20, while the second horizontal radiating metallic line 12 is connected to the vertical radiating metallic line 13 at the position different from where the first horizontal radiating metallic line 11 is connected to, wherein the other ends (free ends) of the two horizontal radiating metallic lines 11 and 12 extend outwards in the same direction and thus the antenna 1 is formed as an F shape.

As mentioned above, the path from the feeding point 20 through the vertical radiating metallic line 13 to the free end of the first horizontal radiating metallic line 11 forms the first resonant path of the antenna 1 in operation and determines the first (the lower) operating frequency of the antenna 1. In addition, the path from the feeding point 20 through the vertical radiating metallic line 13 to the free end of the second horizontal radiating metallic line 12 forms the second resonant path of the antenna 1 in operation and determines the second (the higher) operating frequency of the antenna 1. Also note that, probably because there is small coupling between the first and the second resonant paths in the present invention, the first and the second operating frequencies for the desired dual-band WLAN operations can be easily tuned by means of respectively adjusting the lengths of the first horizontal radiating metallic line 11 and the second horizontal radiating metallic line 12.

Figure 3:
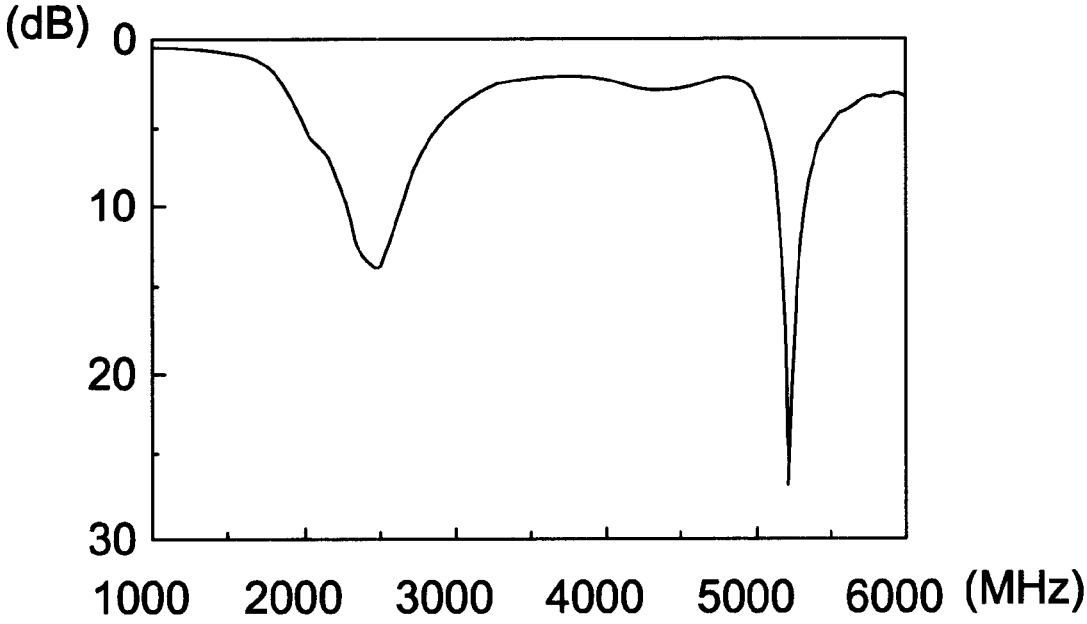
FIG. 3 is a diagram of the measured results showing the return loss of the dual-band monopole antenna in accordance with a preferred embodiment of the present invention.
Figure 4:
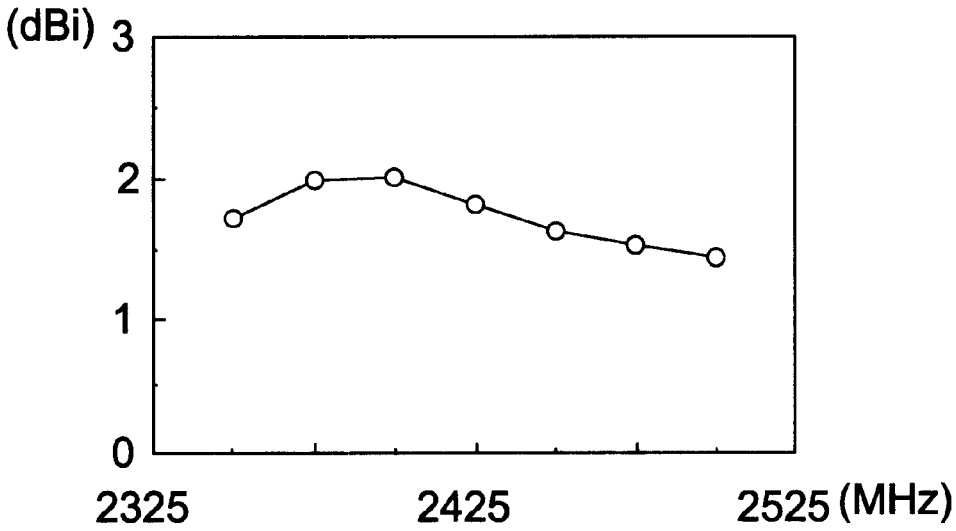
FIG. 4 is a diagram of the measured results showing the antenna gain of the dual-band monopole antenna in the 2.4 GHz band for WLAN operation in accordance with an embodiment of the present invention.
Figure 5:
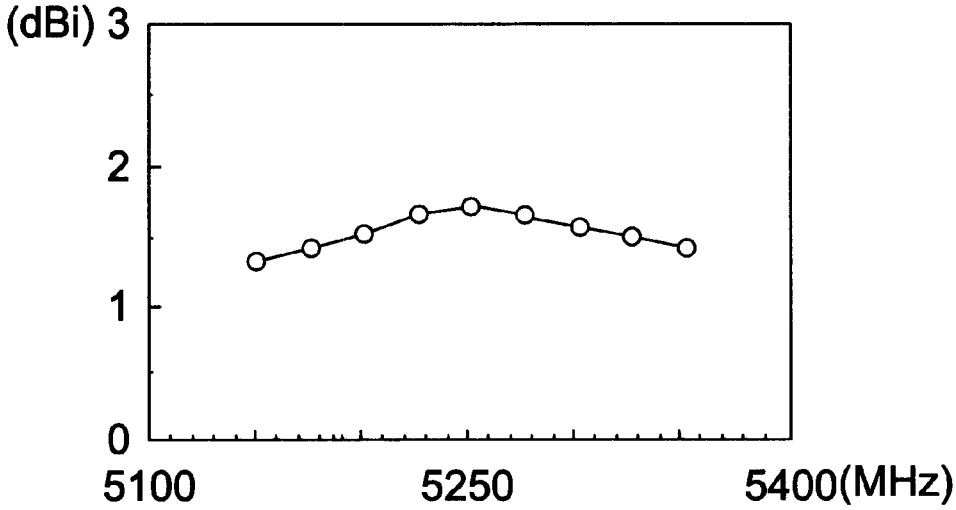
FIG. 5 is a diagram of the measured results showing the antenna gain of the dual-band monopole antenna in the 5.2 GHz band for WLAN operation in accordance with an embodiment of the present invention.

FIG. 3 through FIG. 5 depict the experimental results of the dual-band monopole antenna 1 in accordance with the present invention shown in FIG. 1 and FIG. 2. The experimental results of FIG. 3 to FIG. 5 are obtained under the condition that the microwave substrate 40 has a dielectric constant 4.4 and is 0.8 mm in thickness; the dual-band monopole antenna 1 is 10×15 $mm^2$ in dimension; the first horizontal radiating metallic line 11 is 10 mm in length; the second horizontal radiating metallic line 12 is 7 mm in length; the vertical radiating metallic line 13 is 15 mm in length; and the dimension of the rectangular or substantially rectangular shaped breach 51 is 15×15 $mm^2$.

FIG. 3 depicts that, under the condition (definition) that the VSWR (voltage standing wave ratio) equals to 2.5 or the return loss equals to 7.3 dB, the bandwidth of the first (the lower) operating mode of the antenna 1 is 570 MHz (2185–2755 MHz) and the bandwidth of the second (the higher) operating mode thereof is 280 MHz (5115–5395 MHz), wherein the operating bandwidth can cover the bandwidth required for the 2.4 GHz (2400–2484 MHz) and 5.2 GHz (5150–5350 MHz) bands for WLAN operations.

FIG. 4 and FIG. 5 depict the measured results of the antenna gain of the antenna 1 operated respectively in the 2.4 GHz band and 5.2 GHz band. In the 2.4 GHz band, the antenna gain is between about 1.4 dBi and about 2.0 dBi, and in the 5.2 GHz band, the antenna gain is between about 2.3 dBi and about 2.7 dBi, and thus it has been found that the antenna 1 in both of the first and second operating modes is provided with desirable antenna gain.

Figure 6A:
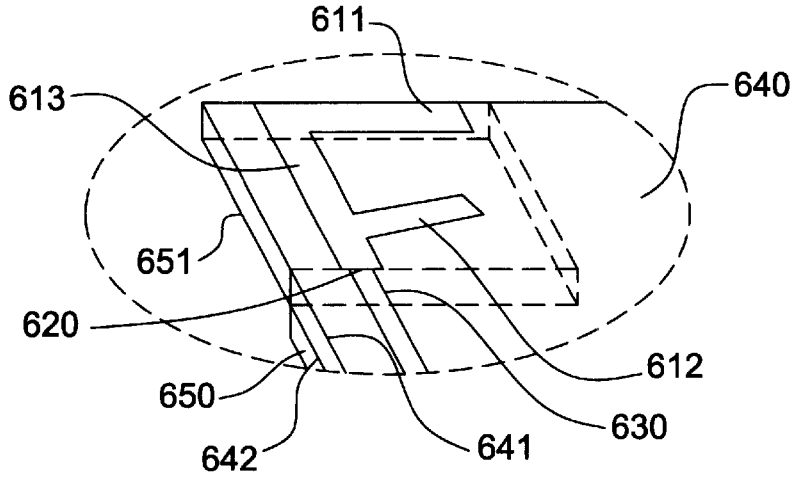
FIG. 6*a* through FIG. 6*c* are perspective views of dual-band monopole antennas in accordance with other embodiments of the present invention.
Figure 6B:
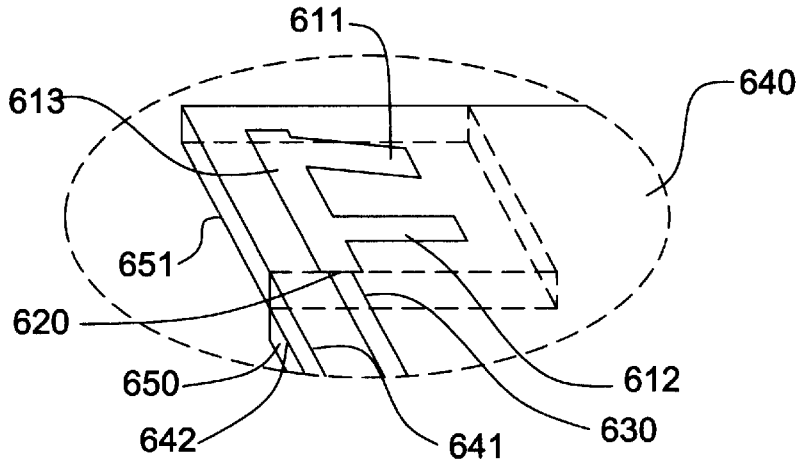
Figure 6C:
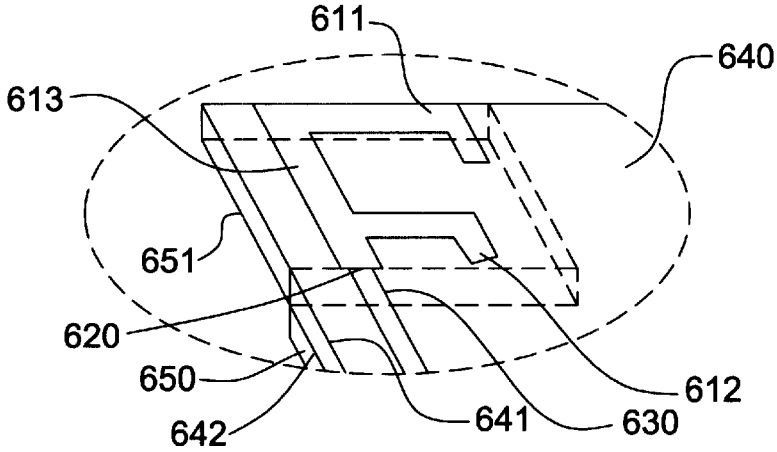

FIG. 6*a* through FIG. 6*c* depict perspective views of the dual-band monopole antenna 1 of other embodiments in accordance with the present invention. As shown in FIG. 6*a* and FIG. 6*b,* they depict that the first horizontal radiating metallic line 611 is connected to one end of the vertical radiating metallic line 613 or the vicinity thereof opposite to the feeding point 620, while the second horizontal radiating metallic line 612 is connected to the vertical radiating metallic line 613 at the position different from where the first horizontal radiating metallic line 611 is connected to, wherein the other ends (free ends) of the two horizontal radiating metallic line 611 and 612 extends outwards in the same direction. Compared with the antenna 1 shown in FIG. 2, the first horizontal radiating metallic line 611 may not precisely parallel to the second horizontal radiating metallic line 612 such that the arrangement of the first horizontal radiating metallic line 611, the second horizontal radiating metallic line 612 and the vertical horizontal radiating metallic line 613 is more flexible, thereby enhancing the integration between the antenna 1 and the system circuit of the microwave substrate 640. Also, as shown in FIG. 6*c,* the first horizontal radiating metallic line 611 and the second horizontal radiating metallic line 612 can be bent downward in order to reduce the proportion of the area on the microwave substrate occupied by the antenna 1, thereby fulfilling the reduced-volume requirement of the electric products.

While the foregoing description and drawings represent the preferred embodiments of the present invention, it should be understood that various additions, modifications and substitutions may be made therein without departing from the spirit and scope of the principles of the present invention as defined in the accompanying claims. One skilled in the art will appreciate that the invention may be used with many modifications of form, structure, arrangement, proportions, materials, elements, and components. The presently disclosed embodiments are therefore to be considered in all respects as illustrative and not restrictive, the scope of the invention being indicated by the appended claims and their legal equivalents, and not limited to the foregoing description.

What is claimed is:

1. A dual-band monopole antenna comprising:

a multiple-layer substrate having a first layer and a second layer, said second layer served as a ground plane with an empty region;

a plurality of radiating metallic lines arranged in substantially an "F" shape on said first layer and above said empty region for generating a first frequency band and a second frequency band, said plurality of radiating metallic lines having a first and a second radiating metallic lines substantially spaced apart, and a third radiating metallic line connected to said first and said second radiating metallic lines from the same side; and a feeding point located at a free end of said third radiating metallic line.

2. The dual-band monopole antenna as claimed in claim 1, wherein said first layer is on a surface layer of said multiple-layer substrate.

3. The dual-band monopole antenna as claimed in claim 1, wherein a path from said feeding point through said third radiating metallic line to a free end of said first radiating metallic line forms a first resonant path and determines said first frequency band.

4. The dual-band monopole antenna as claimed in claim 1, wherein a path from said feeding point through said third radiating metallic line to a free end of said second radiating metallic line forms a second resonant path and determines said second frequency band.

5. The dual-band monopole antenna as claimed in claim 1, wherein said first frequency band is about 2.4 GHz.

6. The dual-band monopole antenna as claimed in claim 1, wherein said second frequency band is about 5.2 GHz.

7. An antenna structure for wireless communication comprising:

a card adapted to a wireless device;

a multiple-layer substrate on said card and having a first layer and a second layer, said second layer served as a ground plane with two empty regions; and two antennas on two sides of said multiple-layer substrate and above said two empty regions, each antenna having a plurality of radiating metallic lines arranged in substantially an "F" shape on said first layer for generating a first frequency band and a second frequency band, said plurality of radiating metallic lines having a first and a second radiating metallic lines substantially spaced apart, and a third radiating metallic line connected to said first and said second radiating metallic lines from the same side, a feeding point located at a free end of said third radiating metallic line.

8. The antenna structure for wireless communication as claimed in claim 7, wherein said first layer is on a surface layer of said multiple-layer substrate.

9. The antenna structure for wireless communication as claimed in claim 7, wherein a path from said feeding point through said third radiating metallic line to a free end of said first radiating metallic line forms a first resonant path and determines said first frequency band.

10. The antenna structure for wireless communication as claimed in claim 7, wherein a path from said feeding point through said third radiating metallic line to a free end of said second radiating metallic line forms a second resonant path and determines said second frequency band.

11. The antenna structure for wireless communication as claimed in claim 7, wherein said first frequency band is about 2.4 GHz.

12. The antenna structure for wireless communication as claimed in claim 7, wherein said first frequency band is about 5.2 GHz.

* * * * *